US005616885A

United States Patent [19]

Walters et al.

[11] Patent Number: 5,616,885

[45] Date of Patent: Apr. 1, 1997

[54] APPARATUS FOR DISPERSING A JET FROM A SHAPED CHARGE LINER VIA NON-UNIFORM CHARGE CONFINEMENT

[75] Inventors: William Walters, Elkton; Richard Summers, Conowingo, both of Md.

[73] Assignee: The United States of America as represented by the Secretary of the Army, Washington, D.C.

[21] Appl. No.: 668,606

[22] Filed: Jun. 3, 1996

[51] Int. Cl.[6] ..... F42B 12/10

[52] U.S. Cl. ..... 102/476; 102/306

[58] Field of Search ..... 102/306–310, 102/476; 89/1.15; 175/4.6

[56] References Cited

U.S. PATENT DOCUMENTS 2,419,414 4/1947 Mohaupt .

2,837,995 6/1958 Castel ..... 102/306

3,732,818 5/1973 Thomanek ..... 102/476

4,513,664 4/1985 Segletes ..... 102/476

*Primary Examiner*—Harold J. Tudor

*Attorney, Agent, or Firm*—Freda L. Krosnick; Paul S. Clohan

[57] ABSTRACT

An apparatus is provided for selectively altering the jet pattern produced by a shaped charge round upon detonation by selectively providing confinement mass(es) on the surface of an outer casing of the round. Confinement mass(es) may be provided to induce a tamping effect upon detonation of the round. The placement of the confinement mass(es) relative to one another and to the round may produce different resulting jet patterns upon detonation. The mass(es) may be movable or removable such that the round may be configured to produce different jet patterns in the field or prior to targeting. Coherent or diffused jet patterns may be utilized, for example to penetrate armor of differing thicknesses or to alter the damage area created by the round.

3 Claims, 4 Drawing Sheets

APPARATUS FOR DISPERSING A JET FROM A SHAPED CHARGE LINER VIA NON-UNIFORM CHARGE CONFINEMENT

STATEMENT OF GOVERNMENT INTEREST

The subject matter of the present application was developed by employees of the U.S. Government, Department of the Army, Army Research Laboratory, in the course of their employment. The U.S. Government has a paid-up license in this invention and the right to require the patent owner to license others on reasonable terms.

CROSS-REFERENCE TO RELATED APPLICATIONS

The subject matter of this application is related to that disclosed in copending applications Ser. Nos. 08/543,972 filed Oct. 17, 1995, now U.S. Pat. No. 5,551,346, 08/543,973 filed Oct. 17, 1995, now U.S. Pat. No. 5,569,873, and 08/544,082 filed Feb. 14, 1996.

FIELD OF THE INVENTION

The present invention relates to a method and apparatus for dispersing a jet from a shaped charge liner in an ammunition round to provide a wider impact area against large targets.

BACKGROUND OF THE INVENTION

Shaped charge designs in present use (i.e., in weapon systems, oil well completion, or drilling operations) may be designed to provide a deep hole in a target material and maximize crater volume. Such shaped charge configurations achieve maximum penetration by projecting a continuous rod or a stream of particles, in near perfect alignment, against a target material. Since penetration is directly proportional to the length of the penetrator, care is taken to maximize the jet length and to keep jet particles well aligned. This concept results in deep holes, of relatively small diameter, in a target.

However, certain applications may require attack of relatively thin targets (i.e., materials of low strength and small thicknesses). Conventional shaped charges do relatively little damage against such targets. For example, a shaped charge fired against a lightly armored vehicle will do minimal ballistic damage. The jet will perforate such a vehicle leaving only a small entrance and exit hole. Against targets of this type, it may be advantageous to reduce the effective depth of penetration and spread the impacting penetrator jet over a wider surface area to maximize the total damage to the target. This type of damage may be obtained by dispersing the jet in a radial fashion to increase the surface area impacted by the jet.

In addition, it may be desirable to provide a particular jet pattern for particular types of targets. For example, when using a shaped charge to destroy a missile or the like, a particular pattern may be desirable to insure that at least a portion of the penetrator jet impacts the missile.

Moreover, it may be desirable to provide a shaped charge round which may be selectively provided with either aligned or dispersed shaped charges to provide either aligned or dispersed jet patterns, respectively when detonated. The use of a single round type to provide both types of charges may reduce inventory costs significantly and allow for selection, in the field, of charge type for a given round. In addition, the use of a same or similar charge type for both aligned and dispersed shape charge types may reduce manufacturing costs of such charges due to the economies of scale in manufacturing a common charge design.

FIG. 1 is a cross section view of a prior art shaped charge round. Explosive fill 10 within casing 24 surrounds a hollow cavity made by liner 15. Liner 15 is illustrated in FIG. 1 as a conical insert with a thin wall although any arcuate geometry may be used depending on desired result. Casing 24 may be a regular cylinder or may take other forms (e.g., tapered or boat-tailed cylinder). The shaped charge round of FIG. 1 may be typically point initiated by a booster/detonator assembly 18 located along an axis of revolution of the round.

The shaped charge round of FIG. 1 may be incorporated into an artillery shell, mortar shell, missile (e.g., surface to air missile, wire guided missile, air to air missile, or the like) or may be incorporated into charges used for industrial purposes (e.g., oil exploration, mining, explosive welding, or the like).

Once the round of FIG. 1 has been detonated, liner 15 collapses to form a high speed jet. The use of liner 15 is described, for example, in H. Mohaupt, U.S. Pat. No. 2,419,414, issued Apr. 22, 1947, incorporated herein by reference.

SUMMARY AND OBJECTS OF THE INVENTION

A shaped charge ammunition round is provided to selectively produce a coherent or dispersed jet pattern when detonated. The round includes a substantially cylindrical outer casing having an open end. An explosive charge is provided within the substantially cylindrical outer casing. A shaped charge liner is contained in the substantially cylindrical outer casing and covers the open end of the substantially cylindrical outer casing. At least one confining mass may be provided, selectively attachable to an outer surface of the substantially cylindrical outer casing for producing a tamping effect on the shaped charge ammunition round such that a jet pattern produced upon detonation of the shaped charge ammunition round may be dispersed.

The confinement mass may be placed around a portion of an outer diameter of the substantially cylindrical outer casing covering a portion of an outer surface area of the substantially cylindrical outer casing. The portion covered comprises 10% to 90% of the outer surface area of the substantially cylindrical outer casing. The at least one confining mass may comprise at least two confining masses arranged on the outer surface of the substantially cylindrical outer casing in a non-axisymmetric manner. The axial length of the at least one confinement mass may be less than an axial length of the shaped charge ammunition round.

The at least one confinement mass may be engaged with the substantially cylindrical outer casing in a slidable fashion so as to allow the at least one confinement mass to slide fore or aft to alter the pattern of the resulting jet when the shaped charge ammunition round is detonated. The at least one confinement mass may comprise at least two pairs of confinement masses arranged substantially orthogonal to one another such that the resulting jet upon detonation first disperses in a first plane and latter portions of the jet disperse in a second plane substantially orthogonal to the first plane.

The at least one confinement mass may be slidably mounted to the substantially cylindrical outer casing and the at least one confinement mass may be adjusted by sliding them forward or aft and by rotating them around the shaped charge ammunition round prior to detonation of the warhead.

It is an object, therefore, of the present invention, to disperse the jet of a shaped charge round into a dispersed jet.

It is a further object of the present invention to disperse the jet of a shaped charge round into a dispersed jet of a predetermined pattern.

It is a further object of the present invention to provide an inexpensive and readily implemented apparatus for dispersing the jet of a shaped charge round.

It is a further object of the present invention to provide a round design having common elements for both shaped charge and dispersed jet applications.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTIONS OF THE DRAWINGS

DETAILED DESCRIPTION OF THE INVENTION

The present invention provides an apparatus and technique to disperse a jet from a shaped charge liner to provide a wider impact area against large targets. Disruption of a jet from a shaped charge liner may be achieved by altering the charge to mass ratio of the liner/explosive/casing system. In all embodiments, the fundamental concept is to locally alter the charge to mass ratio (i.e., the ratio of the explosive mass to metal mass) to alter the collapse in a non-axisymmetric manner at certain regions of liner 15.

The charge to mass ratio may be altered by either the explosive geometry, the metal geometry, or both. In other words, the explosive may be axisymmetric or the liner metal may be axisymmetric. The alteration of the geometry entails either adding or subtracting metal or explosive mass. Adding confinement elements to the exterior of a charge casing may produce what is known as a tamping effect. By placing the elements in a predetermined pattern, a dispersed jet pattern may be obtained from the detonation of the shaped charge.

Figure 1:
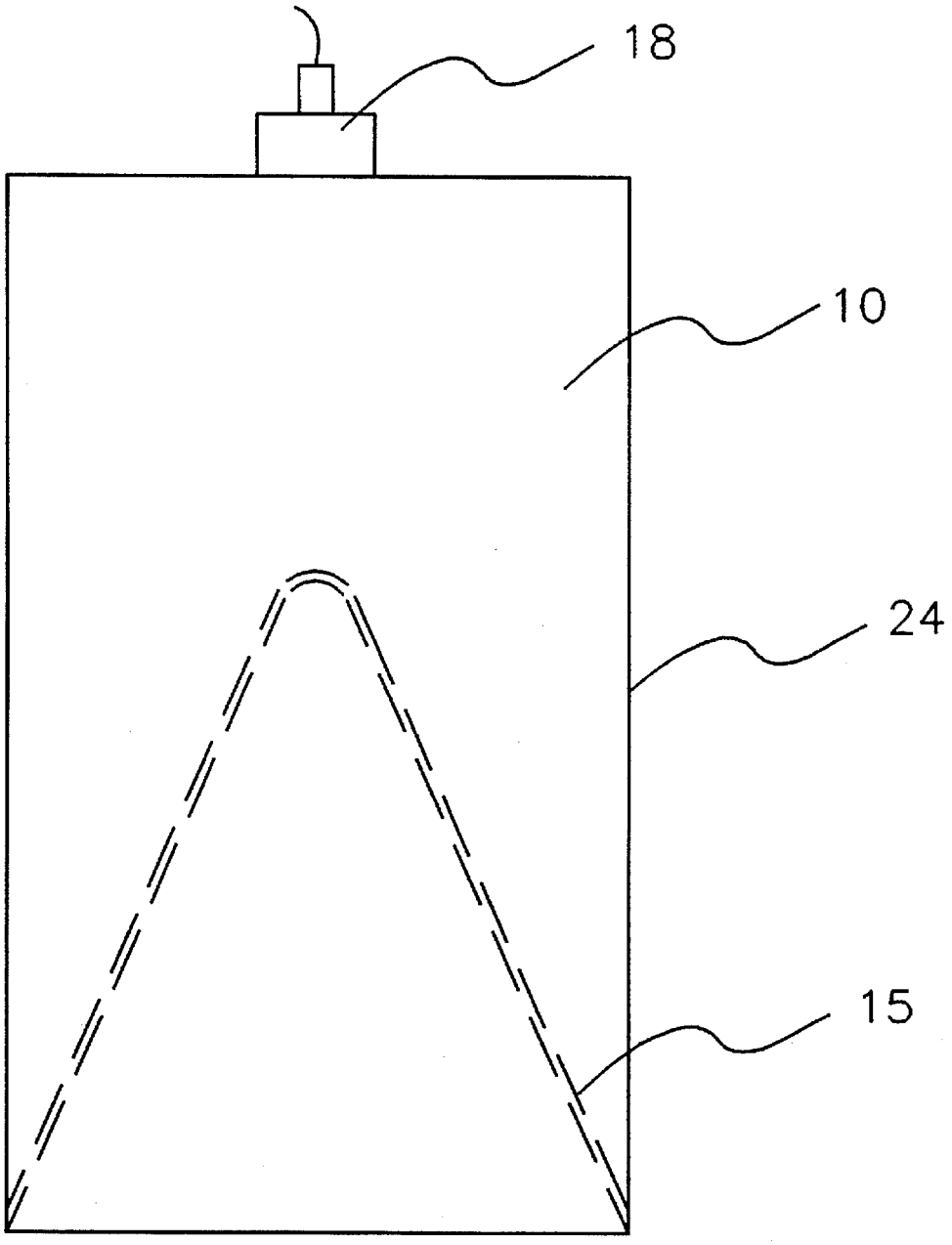
FIG. 1 (PRIOR ART)
FIG. 1 is a side view of a prior art shaped charge illustrating the charge liner in dashed lines.
Figure 2A:
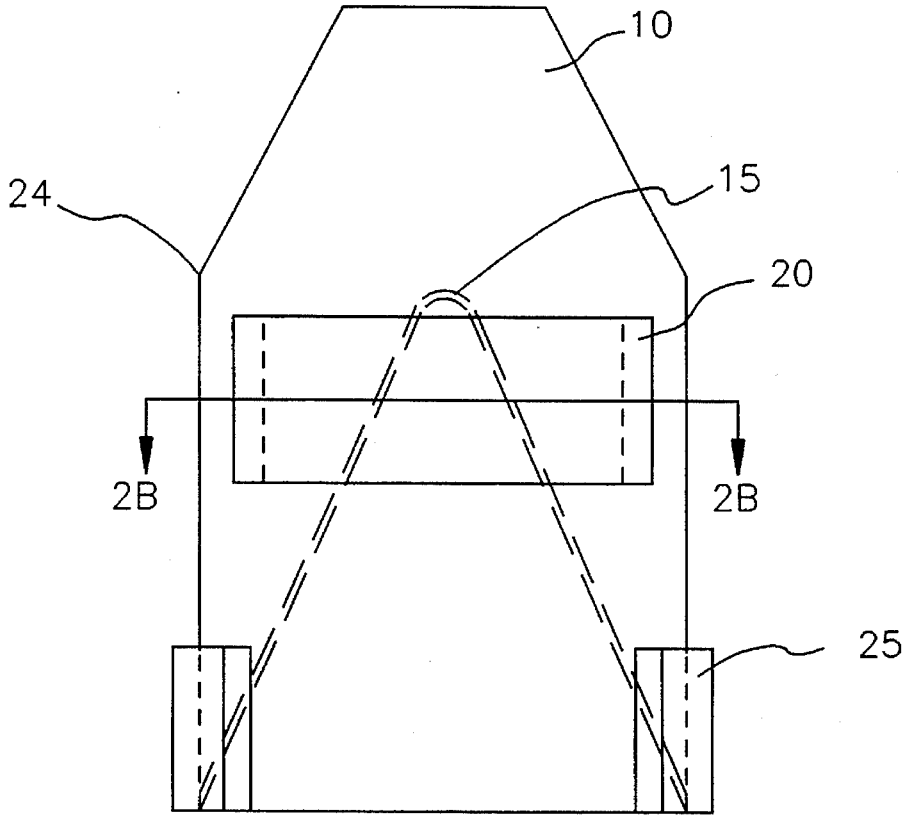
FIG. 2A is a side view of the shaped charge of the present invention illustrating placement of confinement rings.
Figure 2B:
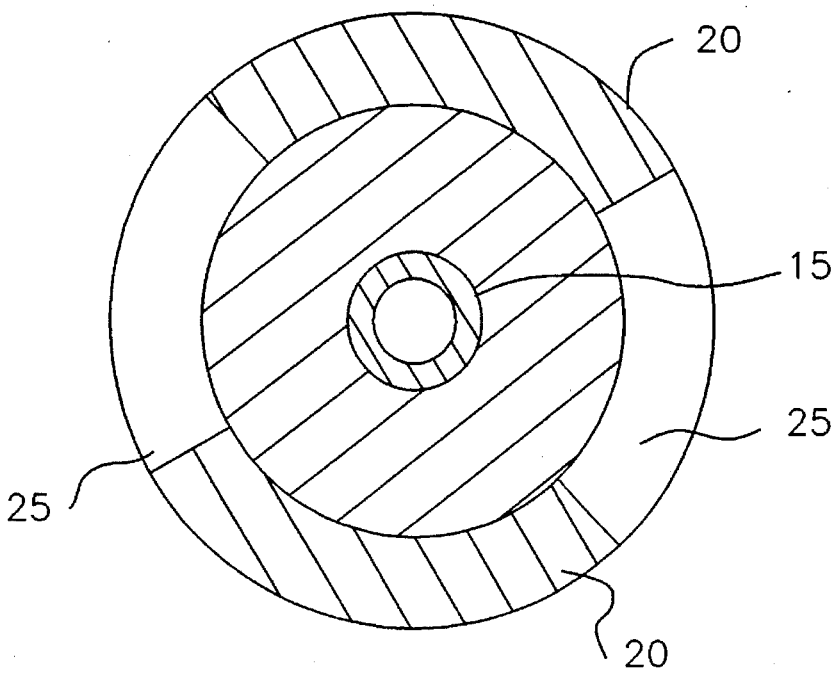
FIG. 2B is a cross-section view of the shaped charge of the present invention along line 2B—2B.

In the preferred embodiment, as illustrated in FIGS. 2A and 2B, alteration in the charge to mass ratio may be accomplished by adding a partial, heavy confinement element to the outer diameter of the explosive. As illustrated in FIG. 2B, the cylindrical charge is circular in cross-section. Confinement elements 20 or 25 in their respective cross-sections, may be placed in quadrants covering, for example, 0 to 90 degrees and 180 to 270 degrees of casing 24, with the regions between 90 to 180 and 270 to 360 degrees being bare. Of course any quadrant may be confined and the confinement regions need not cover 90 degrees and need not be symmetrical depending on the effect desired.

FIGS. 2A and 2B depict axisymmetric liner confinement where the liner 15 is surrounded by explosive 10 which in turn is partially confined by confinement rings 20 and 25. Confinement rings 20 and 25 need not be symmetric or uniform with respect to each other. The use of two symmetric, 60 to 90 degree confinement rings 20 and 25 may result, upon detonation, in a dispersion near the forward third of the jet in one plane behind the tip region. The jet may then reconverge into a coherent portion. With the use of four confinement masses, the jet may further rediverge into a dispersed portion in a plane substantially orthogonal to the first plane.

The thickness of confinement rings 20 and 25 may range from 1/30 to 1/3 of the charge diameter, depending on the confinement material used and the desired effect. Increasing the size and/or density of confinement ring material generally results in an increase in the tamping effect. The more massive the tamping effect, the greater the local effect on the resulting jet. Any high density material may be used for confinement rings. In the tested embodiments, steel was selected, however, other materials may be used within the spirit and scope of the invention, including but not limited to composites, plastics, aluminum or other metals, or even heavy cardboards or other dense paper products.

The length of the confined quadrant need not cover the entire length of the charge. Local jet disruption is achieved with 10% to 100% of the length of the charge covered by confining rings 20 and 25. In the preferred embodiment, confinement rings 20 and 25 may cover only about 1/4 of the charge length. The position of confining rings 20 and 25 may be varied from liner apex to liner base to control the position of the disturbed region in the jet.

The concept of the present invention essentially involves altering the mass to charge ratio by adding tamping mass at selected areas of the charge. This concept may be used to provide jets that are two-dimensional in nature, i.e., lie in one plane. However, by using non-uniform and non-symmetric confinement as shown in FIGS. 2A and 2B, the resulting jet will disperse at two different positions in space, and the two dispersions may be substantially orthogonal to each other.

FIGS. 2A illustrates a shaped charge having a "boat-tailed" cylindrical casing 24. The use of such boat-tailed casings is known in the art and may be provided to reduce the amount of explosive charge 10 needed, as the explosive charge at far regions of the round may have little effect on overall performance of the charge.

Figure 3A:
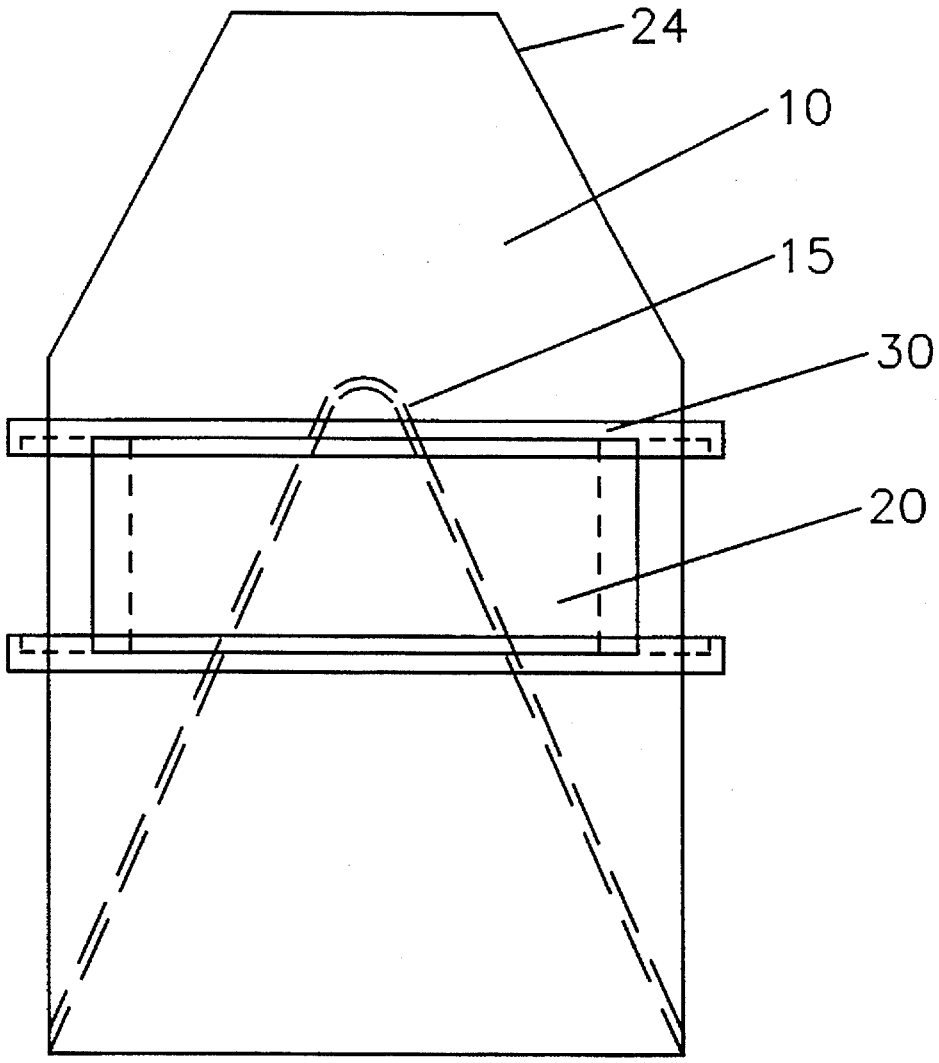
FIG. 3A is a side view of the shaped charge illustrating the use of a slidable mount.
Figure 3B:
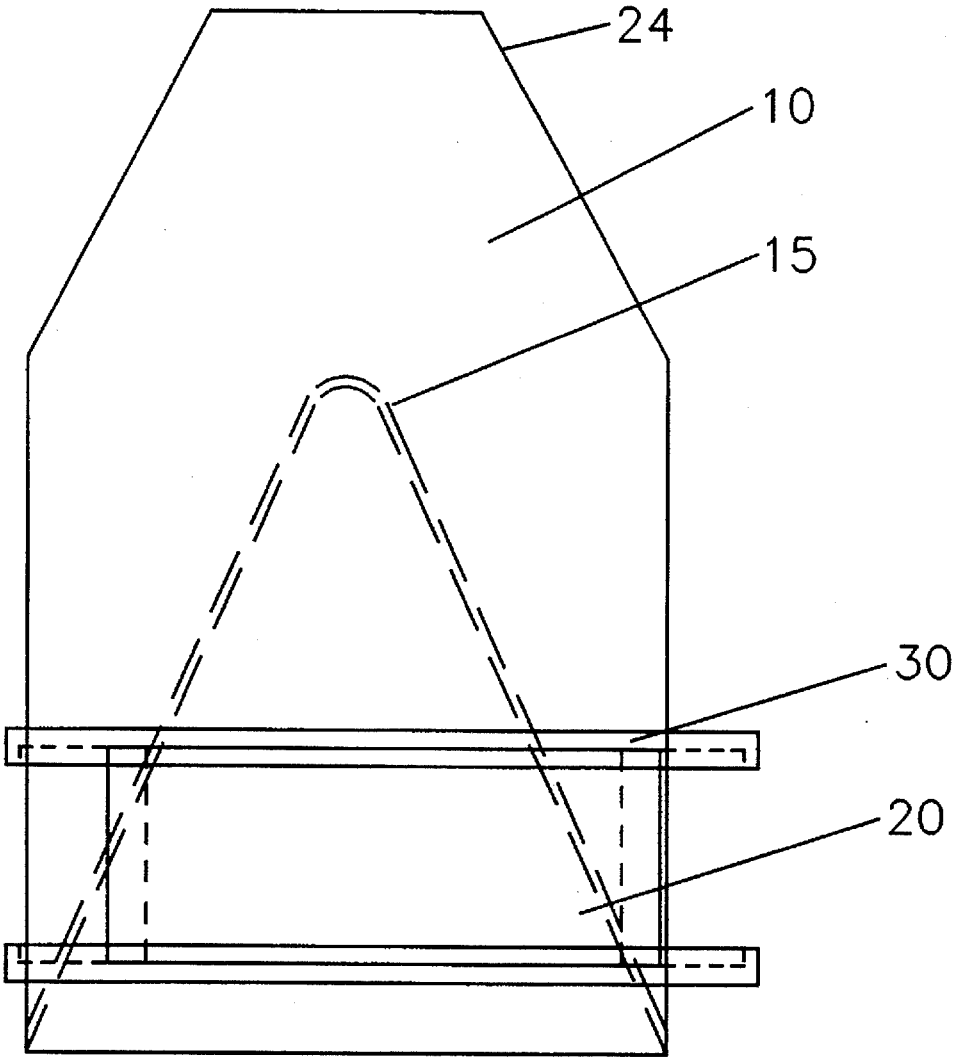
FIG. 3B is a side view of the shaped charge illustrating the use of the slidable mount to change the confinement ring position.

Confinement rings 20 and 25 may be provided in predetermined stationary positions on a round, or may be added in the field. The advantage of such field installation is that the overall pattern of the resulting jet may be altered in the field by adding or moving confinement rings 20 and 25. The use of a common charge design reduces battlefield inventory and provides increased flexibility for the weapon. Moreover, confinement rings 20 and 25 may be provided on slidable mounts such that they may be moved to different positions on the charge prior to firing to adjust the resulting jet pattern from a coherent jet pattern to one of a number of dispersed jet patterns. FIG. 3A shows confinement ring 20 mounted to slidable mount 30. FIG. 3B shows confinement ring 20 rotated and translated about the charge axis.

In addition, such slidable mounts may be actuated such that jet type may be selected, for example, prior to targeting. For example, a missile or the like may be provided with a shaped charge warhead with confinement masses on slidable mounts. Targeting controls may move confinement masses prior to impact in order to optimize target destruction.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

While the preferred embodiment and various alternative embodiments of the invention have been disclosed and described in detail herein, it may be apparent to those skilled in the art that various changes in form and detail may be made therein without departing from the spirit and scope thereof.

What is claimed is:

1. A shaped charge ammunition round for selectively producing a coherent or dispersed jet pattern when detonated, comprising:

a substantially cylindrical outer casing having an open end;

an explosive charge within said substantially cylindrical outer casing;

a shaped charge liner, contained in said substantially cylindrical outer casing and covering the open end of the substantially cylindrical outer casing; and at least two confining masses, each selectively attachable to an outer surface of said substantially cylindrical outer casing for producing a tamping effect on said shaped charge ammunition round such that a jet pattern produced upon detonation of said shaped charge ammunition round is dispersed;

each said confining mass is placed around a portion of an outer diameter of said substantially cylindrical outer casing covering a portion of an outer surface area of said substantially cylindrical outer casing;

each said confining mass comprising a segment of 60 to 90 degrees of a hollow cylinder and said confining masses located on opposite sides of each other and at the same height on said substantially cylindrical outer casing; wherein an axial length of each said confining mass is less than an axial length of said shaped charge ammunition round; wherein each said confining mass is slidably mounted to said substantially cylindrical outer casing so as to allow each said confining mass to slide fore or aft to alter the pattern of the resulting jet when said shaped charge ammunition round is detonated.

2. The shaped charge ammunition round of claim 1, wherein said at least two confining masses comprises two pairs of confining masses arranged substantially orthogonally to one another, each said confining mass comprising a segment of less than 180 degrees of a hollow cylinder and each said pair of confining masses comprising confining masses located on opposite sides of each other and at the same height on said substantially cylindrical outer casing such that the resulting jet upon detonation first disperses in a first plane and latter portions of the jet disperse in a second plane substantially orthogonal to the first plane.

3. The shaped charge ammunition round of claim 1, wherein each said confining mass is adjusted by sliding forward or aft and by rotating around the shaped charge ammunition round prior to detonation of the warhead.

* * * * *